United States Patent [19]

Hirooka et al.

[11] Patent Number: 4,732,016

[45] Date of Patent: Mar. 22, 1988

[54] DEHYDRATING TANK STOPPING MECHANISM FOR SINGLE-TANK TYPE WASHING MACHINE

[75] Inventors: Hiroshi Hirooka; Takeshi Saito; Hirobumi Urabe, all of Chiba, Japan

[73] Assignees: Mitsubishi Denki K.K.; Nihon Kenetetus Co., Ltd., both of Tokyo, Japan

[21] Appl. No.: 831,378

[22] Filed: Feb. 20, 1986

[30] Foreign Application Priority Data

Feb. 20, 1985 [JP] Japan ..... 60-31732

[51] Int. Cl.[4] ..... D96F 37/40

[52] U.S. Cl. ..... 68/23.7; 188/77 R; 192/17 C

[58] Field of Search ..... 68/23.6, 23.7; 192/17 A, 17 C; 188/77 R

[56] References Cited

U.S. PATENT DOCUMENTS 3,100,030 8/1963 McMillan ..... 188/77 R X

FOREIGN PATENT DOCUMENTS 25473 2/1977 Japan ..... 68/23.7

*Primary Examiner*—Philip R. Coe

*Attorney, Agent, or Firm*—Sughrue, Mion, Zinn, Macpeak & Seas

[57] ABSTRACT

In a single-tank dehydration-type agitator-operated washing machine, the agitator and the dehydrating tank are driven by respective drive shafts which are operated by a clutch mechanism selectively in such a manner that the drive shafts are selectively rotated in association with each other or independently of each other. A brake band for operating the two drive shafts independently of each other and the clutch mechanism are operated by a lever. In order to positively engage the brake band with the lever, the lever is driven while the drive shafts are being rotated in one direction in association with each other. In order to cause the lever to engage with the brake band with a suitable timing, the brake band is provided with a collar-shaped engagement regulating plate having a cut formed therein.

6 Claims, 11 Drawing Figures

DEHYDRATING TANK STOPPING MECHANISM FOR SINGLE-TANK TYPE WASHING MACHINE

BACKGROUND OF THE INVENTION

The present invention relates to single-tank dehydration-type agitator-operated washing machines, and more particularly to an improvement in a dehydrating tank stopping mechanism in such a single-tank dehydration-type agitator-operated washing machine.

First, a conventional single-tank dehydration-type washing machine will be described with reference to FIG. 1. As shown in FIG. 1, the washing machine includes a pulsator 20 and a dehydrating (spinning) tank 4 having the pulsator 20 at its center and a side wall is which a number of through-holes 5 are formed. A water holding tank 7 is provided outside the tank 4. The water holding tank 7 has a water discharging outlet (not shown) in its bottom. The water discharging outlet is connected to a drain pipe.

Further in FIG. 1, reference numeral 8 designates an electric motor, which is coupled to a rotation transmitting section 12 through a speed reducing mechanism composed of a pulley 9, a V-belt 10 and a pulley 10. The rotation transmitting section 12 has dual drive shafts 12*a* and 12*b* which are controlled by a spring clutch mechanism 13. The outer drive shaft 12*a* is coupled to the dehydrating tank 4 and the inner drive shaft 12*b* to the pulsator 20.

In a washing operation, the washing load (clothes), water and detergent are put into the dehydrating tank 4, and then the power switch is turned on. As a result, the motor 8 is rotated, and accordingly the pulsator 20 is rotated. The washing operation continues for a predetermined period of time as set by a timer provided in the control device, and then the water is discharged. Thus, a washing operation has been accomplished.

Next, a dehydrating (spin cycle) operation is carried out. In the dehydrating operation, the spring clutch mechanism 13 is operated so that the shaft 12*a* is rotated together with the shaft 12*b*. Therefore, the dehydrating tank 4 and the pulsator 20 are rotated as a unit by the motor 8.

FIGS. 2 and 3 show a conventional mechanism for stopping the rotation of the dehydrating tank. A brake wheel 14 is fixedly mounted on the drive shaft 12*a* of the dehydrating tank 4, and a brake band 15 having a locking pawl 15*a* is passed around the brake wheel 14.

A brake lever 17 having a brake lever spring 16 is provided for the brake wheel 14. When the brake lever 17 is unlocked by means of a solenoid or the like, the locking part 18 provided at the end of the brake lever 17 is abutted against the brake band 15 by the elastic force of the spring 16. However, in this case, the locking part 18 of the lever 17 is not at first engaged with the locking pawl 15*a* of the brake band 15, and therefore the brake band 15 turns together with the brake wheel 14; that is, no braking operation is carried out yet. As the brake band 15 turns, the locking pawl 15*a* finally engages with the locking part 18, as a result of which the brake band 15 is stopped. Therefore, the rotation of the drive shaft 12*a* is stopped by the frictional force between the brake band 15 and the drive shaft 12*a* of the dehydrating tank 5, and accordingly the dehydrating tank 4 is stopped. In this case only the drive shaft 12*b* of the pulsator 20 is permitted to rotate (upon disengagement of clutch 13).

In the dehydrating operation, the lever 17 is moved away from the brake band 15 against the elastic force of the spring 16 by means of a solenoid or the like. As a result, the locking part 18 of the lever 17 is disengaged from the locking pawl 15*a* of the brake band 15, and therefore the drive shaft 12*a* of the dehydrating tank 4 is rotated together with the drive shaft 12*b* of the pulsator 20 at high speed.

To change between rotation of the shafts 12*a* and 12*b* as a unit and rotation of only the shaft 12*b*, the spring clutch mechanism 13 is operated. The construction of the spring clutch mechanism 13 will be described with reference to FIG. 3.

In FIG. 3, reference numeral 13*a* designates the clutch gear of the spring clutch mechanism 13. Simultaneously when the lever 17 starts the braking operation, the ratchet 19*a* at the end of the operating lever 19, which is integral with the brake lever 17, is engaged with the clutch gear 13*a*. With the gear 13*a* held fixed in this manner, the internal spring is released and the drive shafts 12*a* and 12*b* are disconnected from each other. As a result, only the drive shaft 12*b* is rotated; that is, only the pulsator 20 is rotated while the dehydrating tank 4 is maintained stopped.

The dehydrating tank stopping mechanism of a conventional single-tank dehydration-type pulsator-operated washing machine has been described above. The application of a spring clutch mechanism to an agitator-operated washing machine suffers from difficulties as will now be described.

FIG. 4 is a vertical sectional view of a single-tank dehydration type agitator-operated washing machine. In FIG. 4, those components which have been described with reference to FIG. 1 are designated by like reference numerals.

As is well known in the art, an agitator-type washing machine uses an agitator 1 instead of the pulsator 20. The agitator 1 turns through an angle smaller than 360°. In general, the agitator 1 is rocked through about 240° by alternately rotating the electric motor 8 in the forward and reverse directions.

When a braking operation is started by abutting the locking part 18 of the brake lever against a point (for instance, the point A in FIG. 5) on the brake band 15 which is more than 240° away from the locking pawl 15*a* of the brake band 15, the locking part 18 will never reach the locking pawl 15*a*. That is, the locking part 18 will never engage the locking pawl 15*a* because the motor 8 is alternately rotated in the forward and reverse directions, and the drive shafts 12*a* and 12*b* and the brake wheel 14 are rocked through angles smaller than 240° (angles smaller than angle A-B in FIG. 5, alternately in the forward and reverse directions). Accordingly, the dehydrating tank 4 is not braked, and can thus be driven by the agitator 1 through the medium of the clothes, etc. in the tank 4. As a result, no water eddy current is formed in the tank.

SUMMARY OF THE INVENTION

Accordingly, an object of the invention is to eliminate the above-described difficulties. More specifically, an object of the invention is to provide a dehydrating tank stopping mechanism for a single-tank dehydration-type agitator-operated washing machine which utilizes a conventional spring clutch mechanism in combination with a brake mechanism to positively stop the dehydrating tank.

In order to achieve the aforementioned and other objects of the invention, in a dehydrating tank stopping mechanism for a single-tank dehydration-type agitator-operated washing machine according to the invention, the engaging pawl of the brake band is engaged with the locking part of the lever while the rotary shaft of the dehydrating tank is being rotated in one direction, and in order to cause the locking pawl of the brake band to positively engage the locking part of the lever when the agitator is turned in either the former or the reverse direction, the brake band is provided with a collar-shaped engagement regulating plate having a cut formed in such a manner that the cut confronts the locking pawl of the brake band. Accordingly, as the brake band turns, the locking part of the lever moves into the cut of the engagement regulating plate, whereby the locking pawl of the brake band is positively engaged with the locking part of the lever.

DESCRIPTION OF THE PREFERRED EMBODIMENTS

Preferred embodiments of the invention will be described with reference to the accompanying drawings.

Figure 6A:
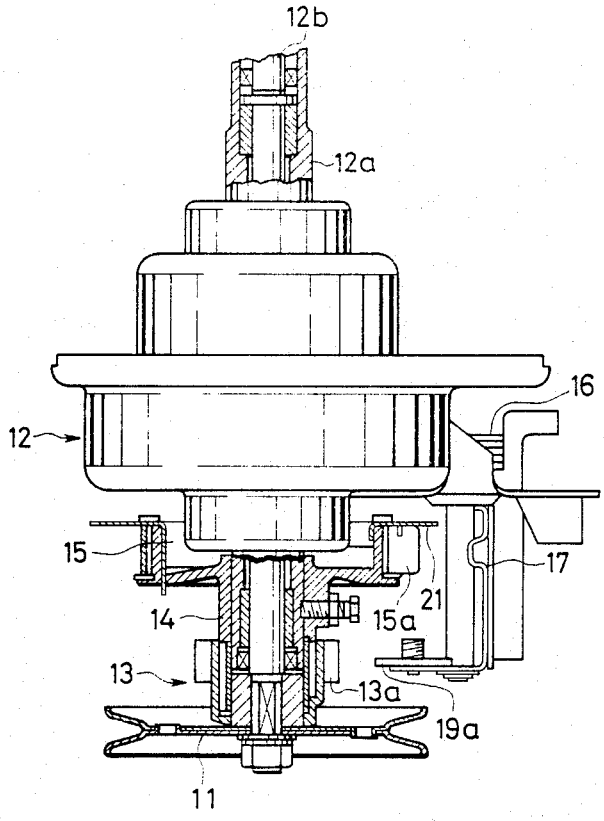
FIG. 6A is a vertical sectional view showing an example of a dehydrating tank stopping mechanism constructed according to the invention.
Figure 7:
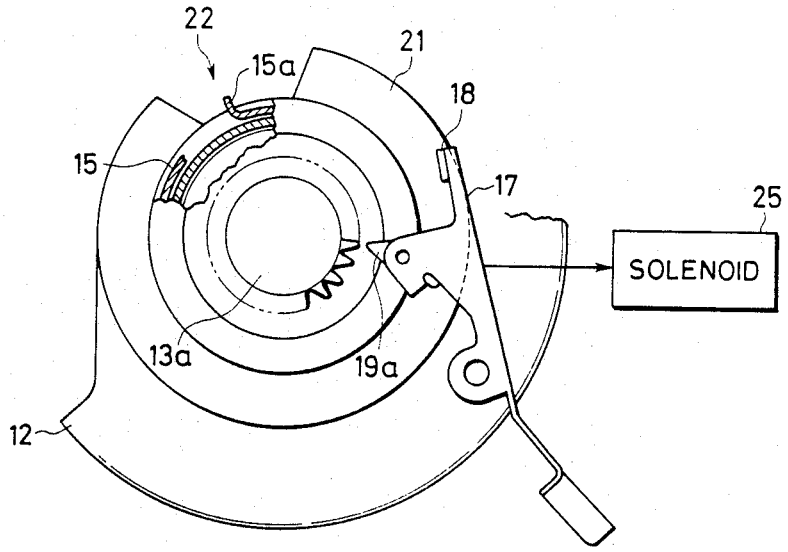
FIGS. 7 and 8 are bottom views provided for a description of the engagement of the brake lever and brake band used in the washing machine of FIG. 6A.
Figure 8:
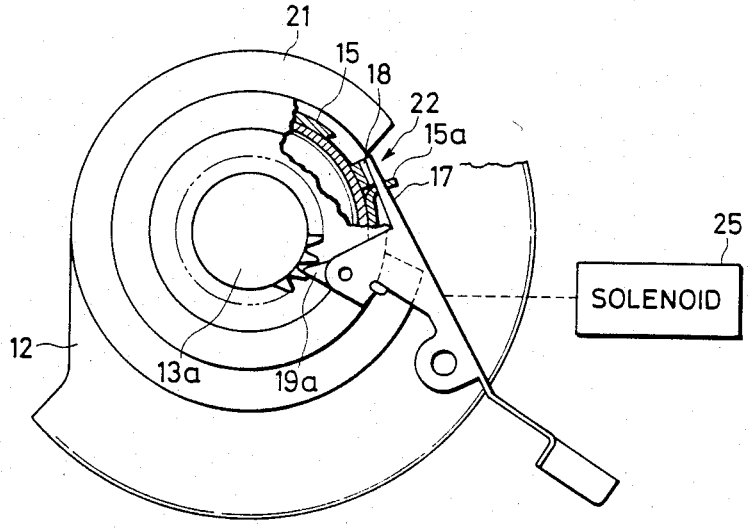

FIG. 6A is a vertical sectional view showing an example of a dehydrating tank stopping mechanism constructed according to the invention. FIGS. 7 and 8 are bottom views of the mechanism. FIG. 6A corresponds to FIG. 2, and FIGS. 7 and 8 to FIG. 5. The construction of the washing machine to which the dehydrating tank stopping mechanism of the invention is applied is the same as that shown in FIG. 4.

Figure 6B:
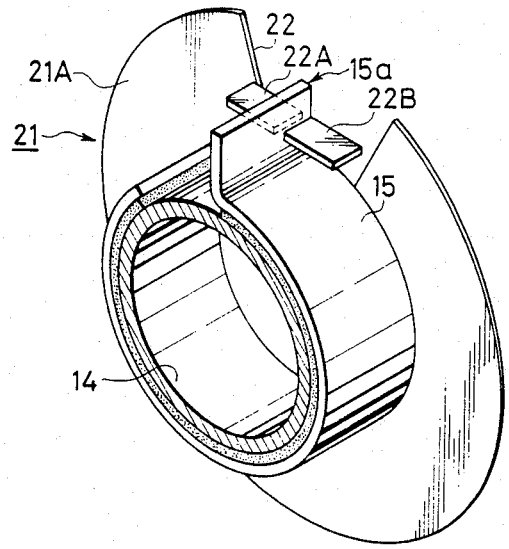
FIG. 6B is a perspective view showing the arrangement of a brake band and a collar-shaped engagement regulating plate.

As shown in FIGS. 6A, 7 and 8, the drive shafts 12*a* and 12*b* are engaged with each other or disengaged from each other by means of the spring clutch mechanism 13. The brake band 15 passed around the brake wheel 14, which is fixedly secured to the shaft 12*a* of the dehydrating tank, has an engagement regulating plate 21 constructed as shown in FIG. 6B. The engagement regulating plate 21 includes a collar 21A which has a cut 22 formed in such a manner that the cut 22 confronts the locking pawl 15*a*. The cut 22 is provided with bent parts 22A and 22B formed in such a manner that the locking pawl 15*a* is positioned between the bent parts 22A and 22B. Accordingly, the brake band 15 and the engagement regulating plate 21 are not moved relative to each other; that is, they operate as a single unit.

The position and the depth of the cut 22 are determined so that the end of the brake lever 17, urged by the brake spring 16, drops into the cut when the locking part 18 of the brake lever 17 is engaged with the locking pawl 15*a* of the brake band and the ratchet 19*a* of the lever 17 is engaged with the clutch gear 13*a*.

Figure 6C:
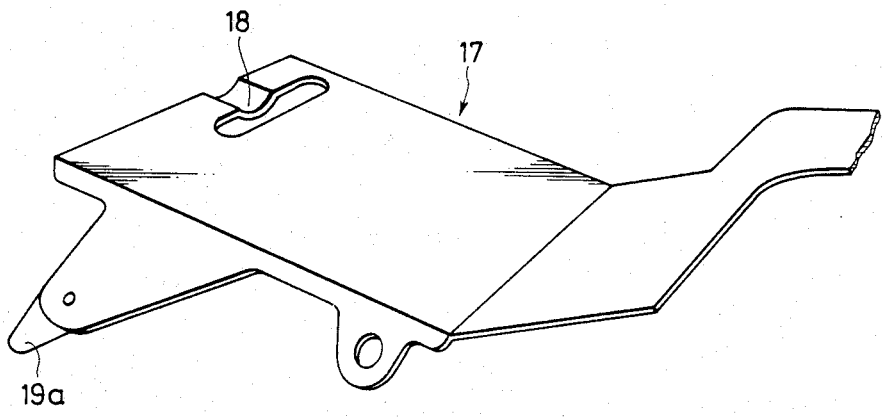
FIG. 6C is a perspective view showing the construction of a brake lever.

The locking part 18 of the brake lever 17, as shown in FIG. 6C, is an opening formed in the end portion of the brake lever 17. The locking part 18 engages the locking pawl 15*a* of the brake band 15 as described above.

The operation of the dehydrating tank stopping mechanism thus constructed will be described.

It is assumed that the dehydrating operation of the washing machine is about to end. At this time, the two drive shafts 12*a* and 12*b* are rotated as a unit. At the end of the dehydrating operation, the braking operation is started and the solenoid is released so that the brake lever 17 is moved by the spring 16.

As a result, a part of the brake lever 17 abuts against the collar 21A of the engagement regulation plate 21 (except when the part confronts the cut 22), and therefore the ratchet 19*a* of the lever 17 cannot yet engage the clutch gear 13 (FIG. 7). In this case, the spring of the spring clutch mechanism 13 is maintained tightened, and the shafts 12*a* and 12*b* are engaged with each other. The motor 8 is then still in the dehydrating mode; that is, the motor 8 is rotating in one direction. Accordingly, as the shaft 12*b* is rotated via the pulley 11 by the motor, the shaft 12*a*, and accordingly the brake band 15, is turned through more than one revolution. During this operation, the cut 22 of the engagement regulating plate 21 arrives at the abutting end lever 17 and the abutting end drops into the cut 22. As a result, the locking pawl 15*a* is engaged with the locking part 18 of the lever 17. Thus, the drive shaft 12*a* is completely braked and the ratchet 19*a* is engaged with the clutch gear 13*a*.

The motor 8 is provided with a tachometer generator 23. The tachometer generator 23 detects the braking operation described above. Specifically, the tachometer generator detects the load applied to the shaft 12*a* and indicates the reduction of this load when the spring clutch mechanism 13 operates. A detection signal indicating this fact applied to a control section 24, the latter being implemented with a microcomputer.

Upon reception of this signal, the control section 24 switches the mode of the motor from rotating in one direction only over to the mode of rotating alternately in one direction and in the opposite direction. Therefore, only the shaft 12*b* is driven and only the agitator 1 is rocked, thus performing the rinsing operation.

The operation of the control section 24 will be described in more detail.

Figure 1:
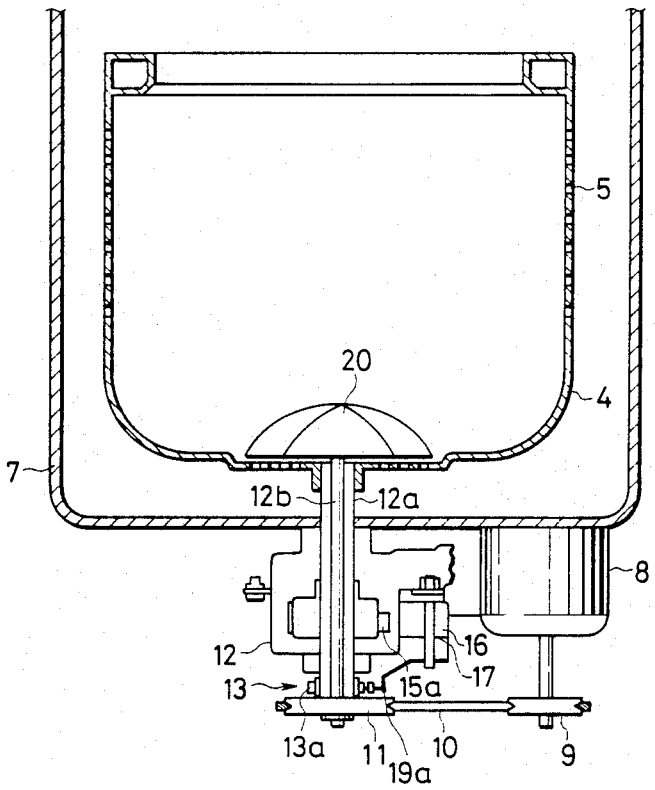
FIG. 1 PRIOR ART
FIG. 1 is a vertical sectional view showing a conventional pulsator-operated washing machine.
Figure 2:
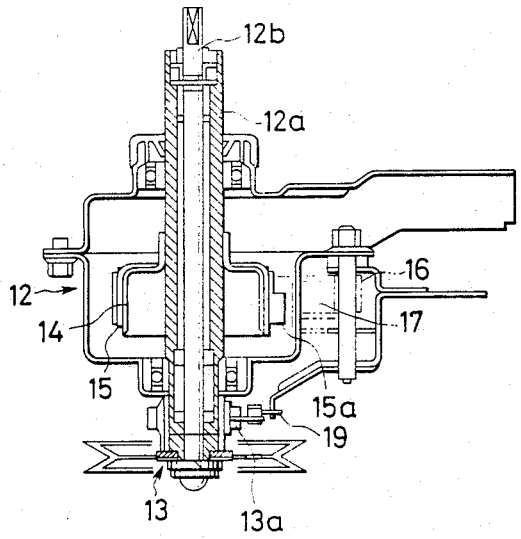
FIG. 2 PRIOR ART
FIG. 2 is a vertical sectional view showing a dehydrating tank stopping mechanism in the washing machine of FIG. 1.
Figure 3:
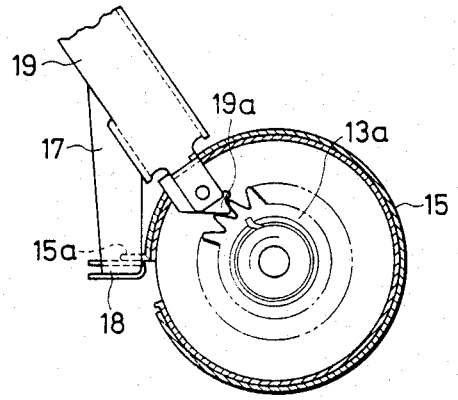
FIG. 3 PRIOR ART
FIG. 3 is a bottom view of the dehydrating tank stopping mechanism shown in FIG. 2.
Figure 4:
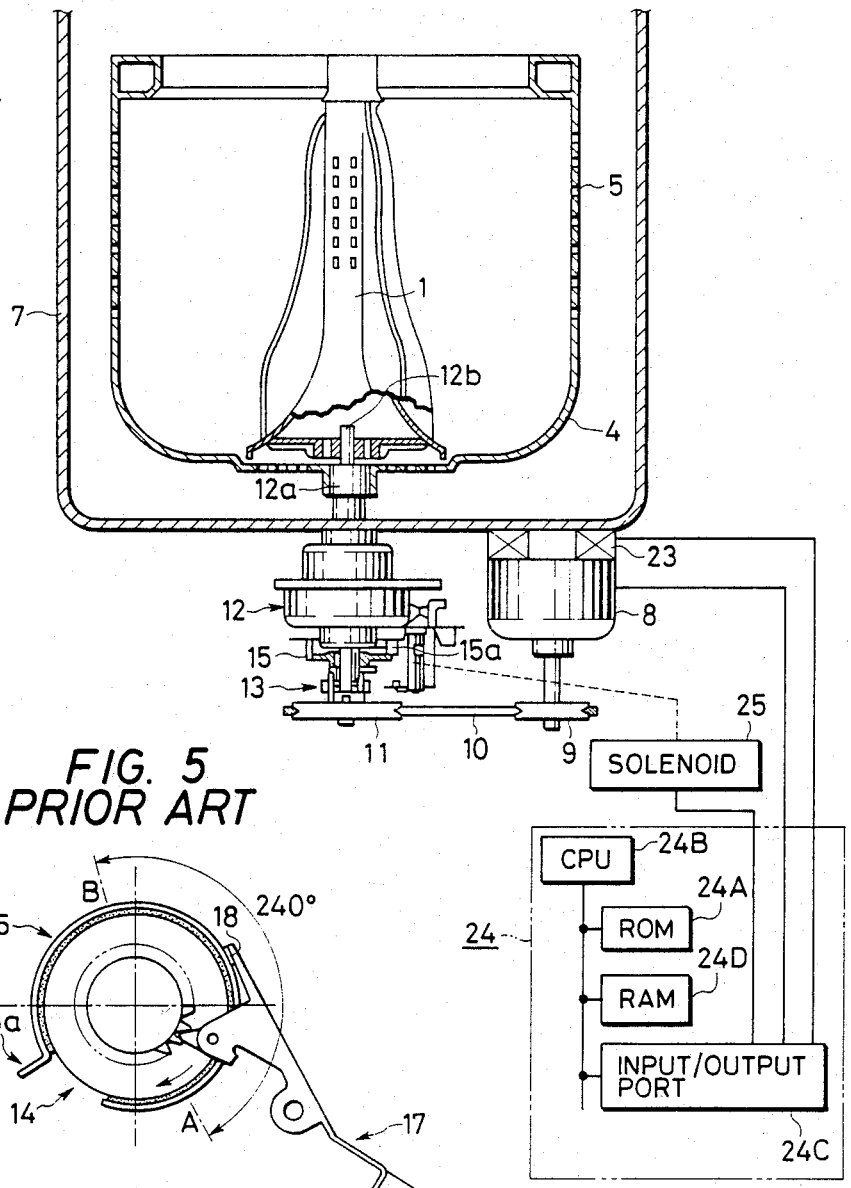
FIG. 4 is a vertical sectional view showing the overall arrangement of a conventional agitator-type washing machine.
Figure 5:
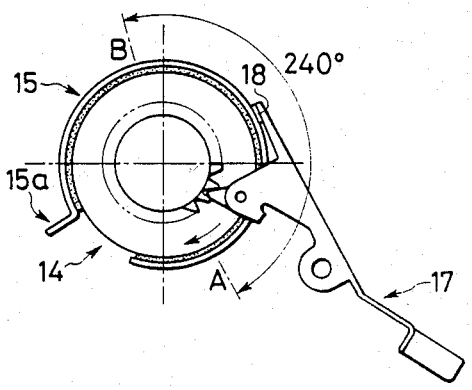
FIG. 5 PRIOR ART
FIG. 5 is a bottom view showing a brake lever and a brake band and is provided to show that the rotation of the dehydrating tank sometimes cannot be stopped in the conventional machine.
Figure 9:
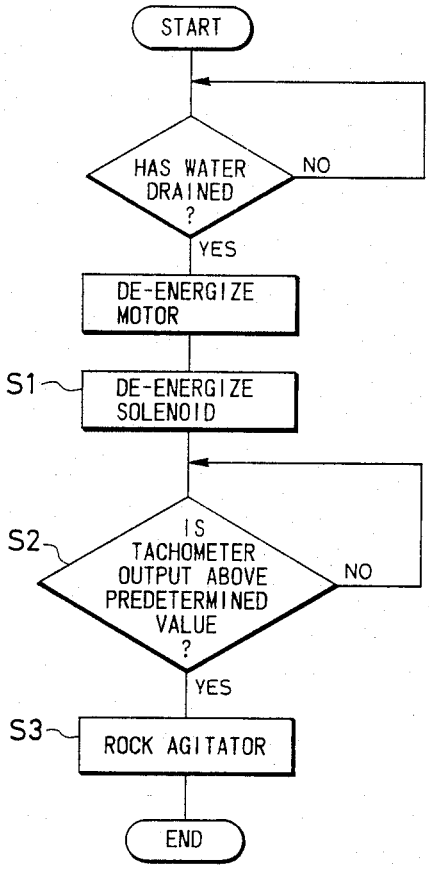
FIG. 9 is a flowchart for a description of the control of the washing machine.

The control section 24, as shown in FIG. 4, includes a read-only memory (ROM) 24A which has stored therein programs for controlling the operation of the washing machine, such as a program for controlling the speed of the motor 8, a program for controlling the washing operation, and a control program as shown in FIG. 9; a central processing unit (CPU) 24B for performing operations according to the control program to output operation instruction signals; an input-output (I/O) port for inputting, for instance, the output signal of the tachometer generator 23 of the motor 8 and transmitting instruction signals from the CPU 24B; and a random access memory (RAM) for temporarily storing signals inputted through the I/O port 24C and for temporarily storing the results of operations performed by the CPU 24B.

When the dehydrating operation should be stopped, the control section 24 operates to suspend the application of current to the motor 8 and to stop and energization of the solenoid 25 (Step S1 in FIG. 9). Then the elastic force of the spring 16 holds the lever 17 as show in FIG. 7. At this time, the shafts 12*a* and 12*b* are still rotating in one direction, and therefore the shafts 12*a* and 12*b* make at least one revolution. Accordingly, when the cut 22 meets the locking part 18 of the lever 17, the locking part 18 drops into the cut 22, thus engaging the locking part 18 with the locking pawl 15*a* of the brake band 15.

Upon engagement of the locking pawl 15*a* with the locking part 18, the rotation of the brake band 15 is stopped, whereupon the rotation of the shaft 12*a* of the dehydrating tank 4 is also stopped. At the same time, the spring clutch mechanism 13 is disengaged from the shaft, and therefore the load applied to the motor 8 is only that of the drive 12*b* of the agitator 1. That is, the load on the motor 8 is reduced and hence the speed of the motor 8 is increased.

The CPU 24B determines whether or not the speed signal provided by the tachometer generator 23 is higher than a predetermined value (Step S2 in FIG. 9). When the speed of the motor 8 becomes higher than the predetermined value, for the next operation (the rinsing operation), the motor 8 is rotated alternately in the forward and reverse directions to thereby rock the agitator 1 (Step S3 in FIG. 9).

In the case of the final dehydrating operation (carried out after the rinsing operation), the control program of FIG. 9 is utilized up to Step S1 (Steps S2 and S3 not being effected). In this case also, in order to engage the locking part 18 with the locking pawl 15*a*, the solenoid 25 is deenergized while the shafts 12*a* and 12*b* are rotating in one direction.

As is apparent from the above description, according to the dehydrating tank stopping mechanism of the invention, the spring clutch mechanism and braking mechanism combined therewith in the conventional pulsator-operated washing machine is applied to a single-tank dehydration-type agitator-operated washing machine without modification. This dehydrating tank stopping mechanism, although simple in construction as described above, can positively stop the dehydrating tank as required.

We claim:

1. A dehydrating tank stopping mechanism for a single-tank type washing machine, comprising:

a dehydrating tank for washing and dehydrating a washing load put therein;

an agitator arranged in said dehydrating tank;

means for rotating said agitator alternately in forward and reverse directions to agitate the water and the washing load in said dehydrating tank, the angle of rotation thereof in each of said forward and reverse directions being no more than 360°;

first and second shafts arranged in the form of a coaxial dual shaft structure and coupled respectively to said dehydrating tank and said agitator;

a clutch mechanism provided for said first and second shafts to selectively allow said first and second shafts to rotate in association with each other or allow only said second shaft coupled to said agitator to rotate; and a brake device provided on said first shaft coupled to said dehydrating tank to stop rotation of said first shaft when said clutch mechanism operates to allow only said second shaft to rotate, said brake device comprising:

a brake wheel mounted on said first shaft coupled to said dehydrating tank;

a brake band passed around said brake wheel; and lever means operated in a braking operation for engaging said brake band to thereby prevent rotation of said brake band and including means for actuating said clutch mechanism to perform a switching operation, said brake band having a collar extending radially of said brake band for regulating the engagement of said lever means with said brake band and said clutch mechanism, and having an opening formed therein, said brake band including lever engaging means protruding within said opening, said lever means being engaged with said lever engaging means of said brake band, and said actuating means being engaged with said clutch mechanism, when said lever extends into said opening, and said lever means being operated when said first and second shafts are being rotated in one direction in association with each other.

2. The dehydrating tank stopping mechanism as claimed in claim 1, wherein said lever engaging means of said brake band comprises a locking pawl protruding from a part of said brake band so as to extend into said opening in said collar.

3. The dehydrating tank stopping mechanism as claimed in claim 2, wherein said lever includes a locking part engageable with said locking pawl of said brake band, said locking part having an opening into which said locking pawl is received when said locking part engages said locking pawl.

4. The dehydrating tank stopping mechanism as claimed in claim 1, further comprising means for operating said lever to perform said braking operation and said switching operation of said clutch mechanism at the end of a dehydrating operation of said washing machine.

5. The dehydrating tank stopping mechanism as claimed in claim 1, further comprising: means for detecting when said lever is engaged with said brake band, and means operating in response to said detecting means for providing an output representing the fact that said lever is engaged with said brake band to operate said agitator to rotate alternately in forward and reverse directions to perform an agitating operation.

6. The dehydrating tank stopping mechanism as claimed in claim 5, wherein said rotating means comprises an electric motor and said detector comprises a speed detector for detecting the speed of rotation of said electric motor, an output of said speed detector changing upon engagement of said lever with said brake band, thus indicating engagement of said lever with said brake band.

* * * * *